US007171775B1

(12) United States Patent
Lacorte

(10) Patent No.: US 7,171,775 B1
(45) Date of Patent: Feb. 6, 2007

(54) GUN SIGHT RETICLE HAVING OPEN SIGHTING AREAS FOR BULLET DROP COMPENSATION

(75) Inventor: Jon B. Lacorte, East Northport, NY (US)

(73) Assignee: Nikon Inc., Melville, NY (US)

( * ) Notice: Subject to any disclaimer, the term of this patent is extended or adjusted under 35 U.S.C. 154(b) by 0 days.

(21) Appl. No.: 11/338,722

(22) Filed: Jan. 25, 2006

Related U.S. Application Data

(63) Continuation-in-part of application No. 11/258,185, filed on Oct. 26, 2005.

(51) Int. Cl.
*F41G 1/38* (2006.01)

(52) U.S. Cl. ..... 42/122; 42/130; 42/133

(58) Field of Classification Search ..... 42/122, 42/130, 126, 125, 111, 119, 120
See application file for complete search history.

(56) References Cited

U.S. PATENT DOCUMENTS

| | | | | |
|---|---|---|---|---|
| 3,392,450 | A | 7/1968 | Herter et al. | |
| 4,584,776 | A | 4/1986 | Shepherd | |
| D285,540 | S | 9/1986 | Allen | |
| 4,789,231 | A | 12/1988 | Shimizu | |
| D306,173 | S | 2/1990 | Reese | |
| 5,491,546 | A | 2/1996 | Wascher et al. | |
| D397,704 | S | 9/1998 | Reese | |
| D403,686 | S | 1/1999 | Reese | |
| 5,920,995 | A | 7/1999 | Sammut | |
| 6,032,374 | A | 3/2000 | Sammut | |
| 6,357,158 | B1 | 3/2002 | Smith, III | |
| D456,057 | S | 4/2002 | Smith, III | |
| D475,758 | S | 6/2003 | Ishikawa | |
| 6,591,537 | B2 | 7/2003 | Smith | |
| 2002/0124452 | A1* | 9/2002 | Sammut | 42/122 |
| 2004/0016168 | A1* | 1/2004 | Thomas et al. | 42/122 |
| 2005/0005495 | A1 | 1/2005 | Smith | |

OTHER PUBLICATIONS

T.D. Smith, III; "Beware the One-Gun Man!"; T.D. Smith, Inc.; pp. 55-62, 65 and 2 pp. drawings figures 1-4; 1992.

* cited by examiner

*Primary Examiner*—Peter M. Poon
*Assistant Examiner*—John Holman
(74) *Attorney, Agent, or Firm*—Oliff & Berridge PLC

(57) ABSTRACT

A gun sight reticle that has orthogonally intersecting center horizontal and center vertical straight hairlines is designed such that at least a portion of the vertical hairline located on a first side of the horizontal hairline is discontinuous such that discontinuities are disposed between straight segments of the vertical hairline. Sighting areas are disposed in at least some of the vertical hairline discontinuities, and the sighting areas are circumscribed by indicia that encloses the sighting area. In one example, the sighting areas are circular, and the indicia for each of the circumscribed sighting areas forms a circle.

29 Claims, 6 Drawing Sheets

GUN SIGHT RETICLE HAVING OPEN SIGHTING AREAS FOR BULLET DROP COMPENSATION

This is a Continuation-in-Part of application Ser. No. 11/258,185 filed Oct. 26, 2005. The entire disclosure of the prior application is hereby incorporated by reference herein in its entirety.

BACKGROUND

1. Field of Invention

The invention relates to gun sight reticles, and in particular to gun sight reticles that provide for bullet drop compensation.

2. Description of Related Art

It is common to use a gun sight, in particular, a telescopic gun sight (also called a "scope"), for longer-range guns such as rifles and for shorter-range guns such as muzzle-loaders and shotguns. With either type of gun, the projectile follows a generally parabolic trajectory. The particular trajectory depends upon both the gun and the projectile. An experienced shooter knows that one must consider the projectile trajectory and distance to target when aiming at the target. Depending upon the distance to the target, one might need to aim over the target so that the projectile strikes the target where intended.

In order to assist shooters, it is known to provide gun sights having aiming points in addition to the central aiming point formed by a center horizontal hairline and a center vertical hairline that forms an aiming point at the center of a reticle. These conventional reticles, known as bullet drop compensation reticles, typically have a plurality of aiming points formed by a plurality of intersecting hairlines located at predetermined distances below the central aiming point. These bullet drop compensation reticles provide additional horizontal hairlines at specified distances below the center horizontal hairline so as to form the additional aiming points where those additional horizontal hairlines intersect the center vertical hairline. See, for example, U.S. Pat. No. 5,920,995 and U.S. Pat. No. 6,591,537. The disclosures of U.S. Pat. No. 5,920,995 and U.S. Pat. No. 6,591,537 are hereby incorporated herein by reference in their entireties.

SUMMARY

The aiming points formed by the intersection of the horizontal hairlines and the center vertical hairline form a plurality of cross-hair aiming points. However, each of the cross-hair aiming points obstructs the shooter's view of the target. If the target is small and/or at a long distance from the shooter, the area of the target covered by the cross-hairs can be substantial and can make it difficult to accurately aim at the target.

In order to address this and/or other problems, one aspect of the invention provides a gun sight reticle in which sighting areas for bullet drop compensation are formed in discontinuities that are disposed on the lower portion of the center vertical hairline. The sighting areas are circumscribed by indicia (such as a circular line) that encloses the sighting area. By providing discontinuities in the center vertical hairline, the sighting areas are not obstructed by any indicia of the reticle, improving the shooter's view of the target.

BRIEF DESCRIPTION OF THE DRAWINGS

The invention will be described in conjunction with the following drawings of exemplary embodiments in which like reference numerals designate like elements, and in which.

DETAILED DESCRIPTION OF EXEMPLARY EMBODIMENTS

Telescopic gun sights (or scopes) generally include a transparent flat disk reticle positioned in a plane perpendicular to the line of sight through the scope. The reticles usually have a center vertical hairline and a center horizontal hairline that intersect each other near the visual center of the reticle. The point of intersection of these hairlines constitutes the primary sighting (aiming) point for the scope and represents the sight of bullet impact at a chosen distance typically referred to as the "zero distance." The gun sight is movably attached to the gun and can be moved in vertical and horizontal directions by way of calibrated adjustment screws on the exterior of the gun sight (internal adjustments), or on the scope attachment system (external adjustments).

By firing a series of shots while making compensatory adjustments of the relative position of the gun sight and thus the reticle center aiming point, the shooting system (the gun, particular type of bullet and gun sight) are "zeroed in" so that the position on the target of the crossed hairlines or center point of the reticle coincides with the point of bullet impact. For a longer-range gun such as a high powered rifle, the gun may be zeroed in at 200 yards such that a bullet fired by the rifle will strike the target when the center aiming point of the reticle is placed over that target during aiming. For a shorter-range gun such as a muzzle loader or a shotgun, the zeroed in range may be 100 yards.

Figure 1:
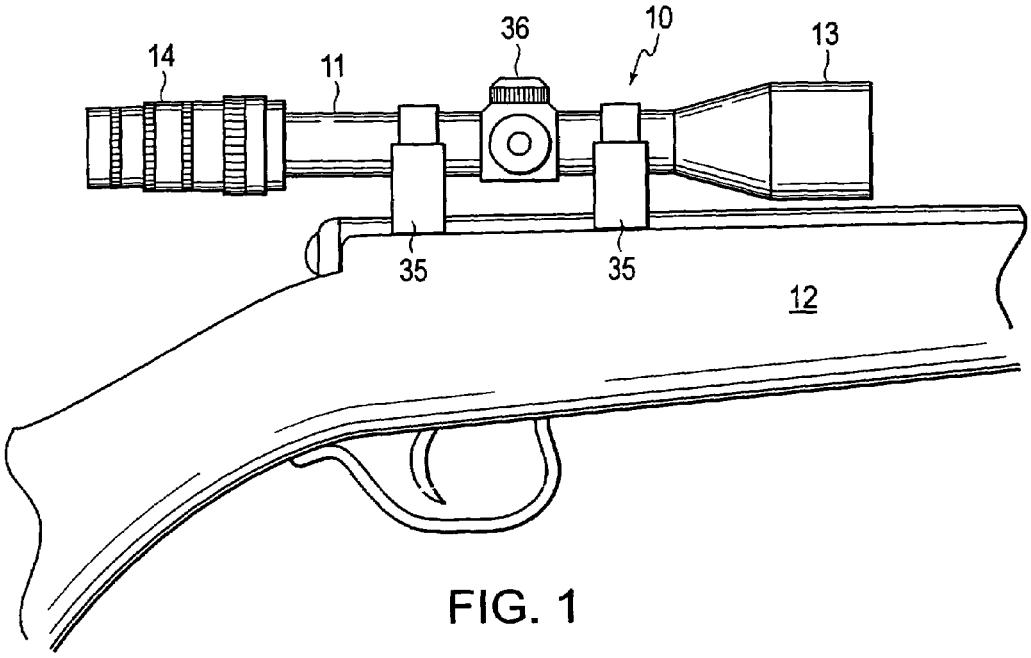
FIG. 1 is a side view of a telescopic sight to which embodiments of the invention may be applied.
Figure 2:
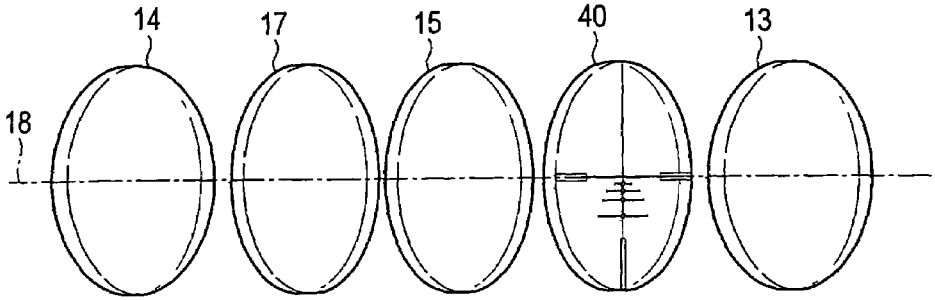
FIG. 2 is a schematic illustration of internal components of a variable power telescopic sight shown in FIG. 1.

As shown in FIGS. 1 and 2, a telescopic gun sight 10 to which the invention may be applied is shown attached by a suitable mount 35 to a rifle 12. The gun sight 10 is formed by a tubular housing 11 containing a forwardly positioned objective lens element 13, a rearwardly positioned ocular or eyepiece lens element 14, an intervening erector lens element 15, and a reticle 40 disposed between the objective lens element 13 and the erector lens element 15. In the case of a vari-focal or zoom scope, a positionally adjustable magnifying lens 17 is associated with the erector lens element 15. The exterior of the housing 11 may be equipped with rotationally movable features 36 for adjusting focus, magnification ratio, windage and elevation. The various lens elements may be single lenses or lens groups.

The reticle 40 is a circular, planar or flat transparent panel or disk mounted within the housing 11 in perpendicular relationship to the optical axis or line of sight 18 of the scope. The reticle 40 is positioned between the objective lens element 13 and the erector lens element 15 at a sight considered to be a front focal plane of the optical system within the housing. The reticle 40 contains fine lines or hairline indicia to be described below.

Figure 3:
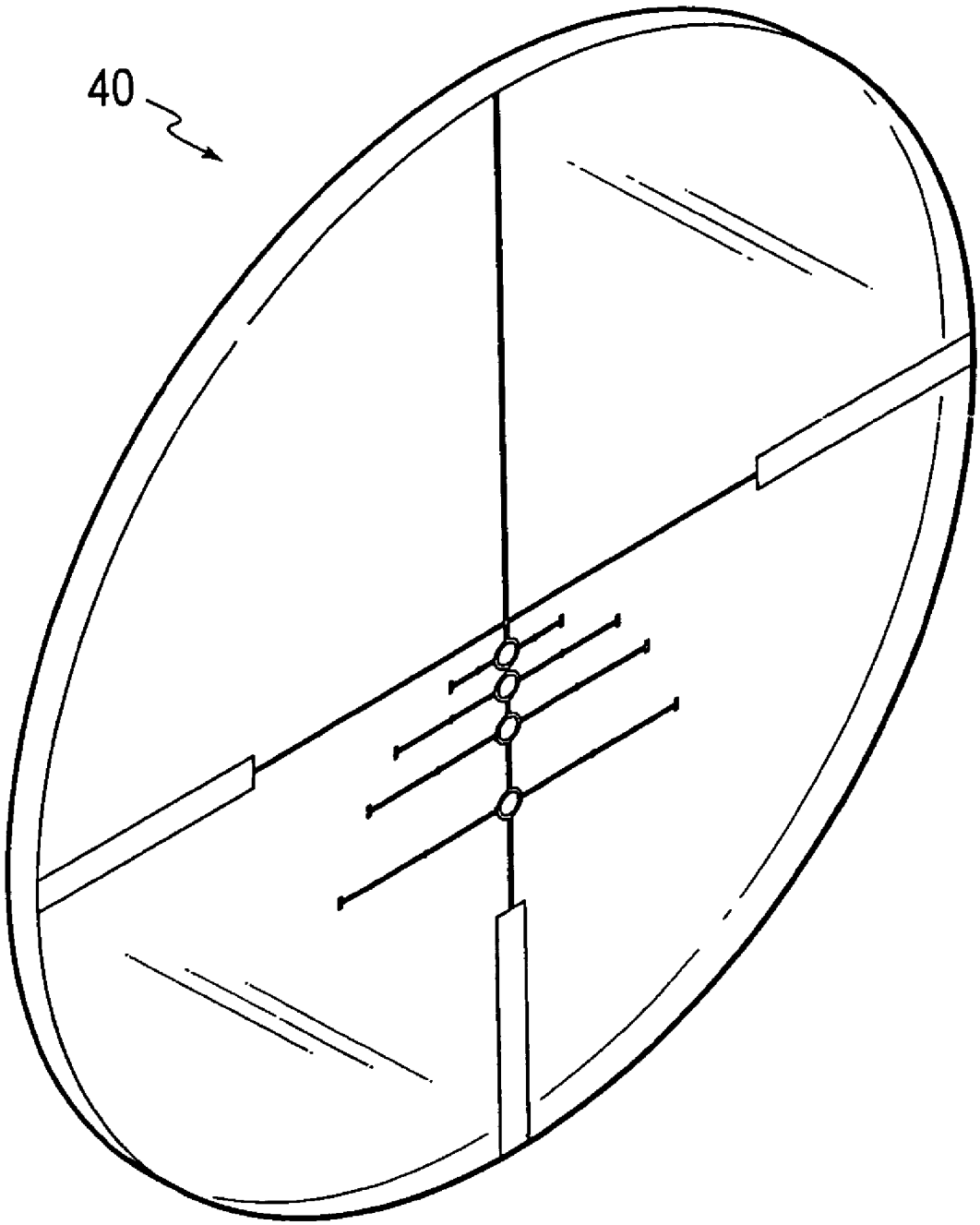
FIG. 3 is a perspective view of a gun sight reticle according to one exemplary embodiment of the invention.
Figure 4:
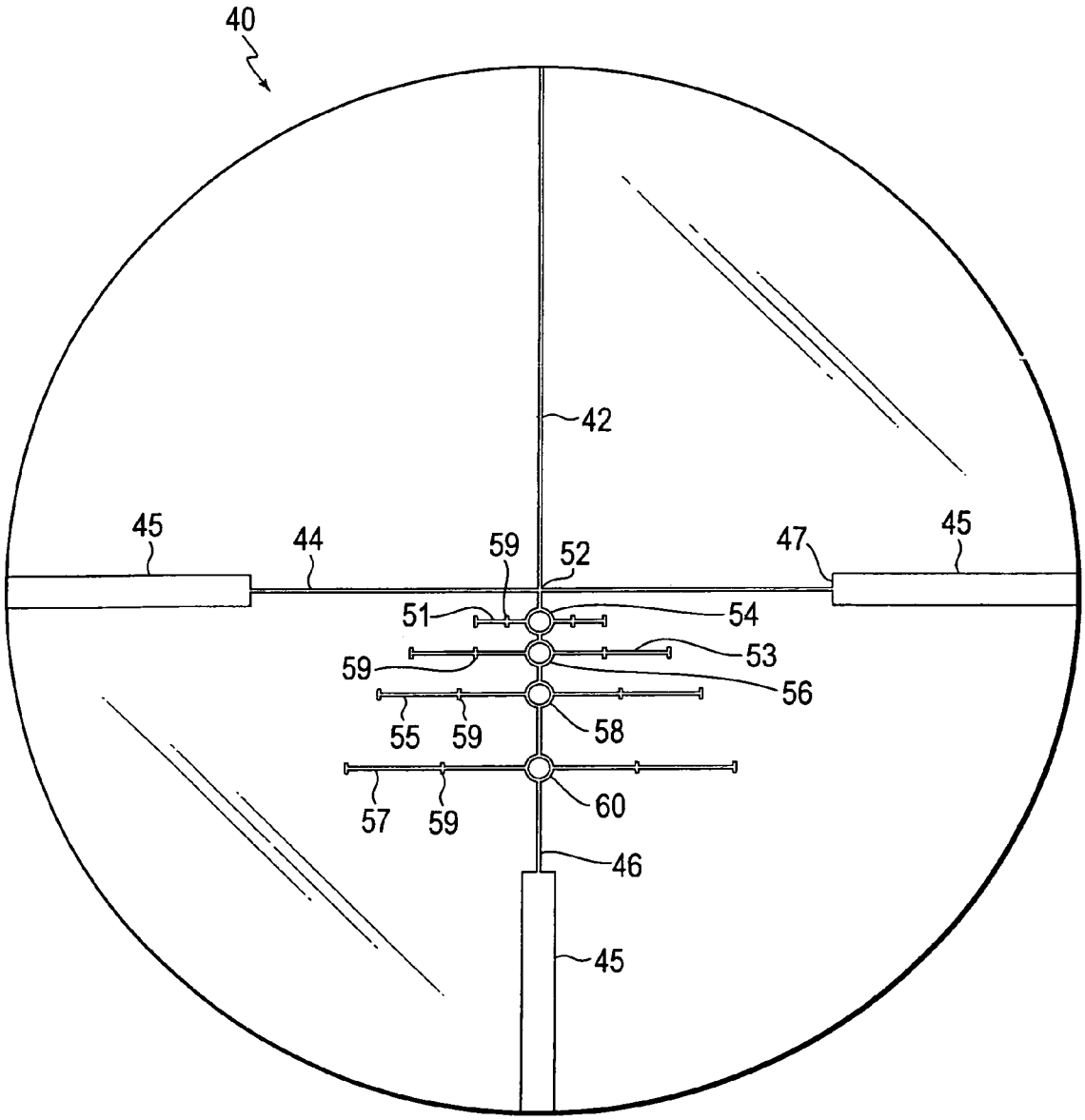
FIG. 4 is a plan view of the FIG. 3 gun sight reticle.

As shown in FIGS. 3 and 4, the reticle 40 includes a center horizontal straight hairline 44 and a center vertical straight hairline 42 that orthogonally intersect each other at the central aiming point 52. The center vertical hairline 42 includes a discontinuous lower portion 46 located below the center horizontal hairline 44. In the example of FIGS. 3 and 4, the lower portion 46 of the center vertical hairline includes four discontinuities. Each of these discontinuities forms a sighting area to be used for bullet drop compensation. Each of the discontinuities is circumscribed by indicia (a hairline) that surrounds the sighting area. In particular, a first sighting area 54 is located below and closest to the central ("zeroed in") aiming point 52. Second sighting area 56 is located below the first sighting area 54. Third sighting area 58 is located below the second sighting area 56. Fourth sighting area 60 is located below third sighting area 58 and is the sighting area that is farthest from the central aiming point 52. The distances between each of the bullet drop compensation sighting areas 54–60 and the central aiming point 52 are chosen based upon the type of gun and scope with which the reticle is to be used, as will be described in more detail below. For example, the spacing between each of the sighting areas will differ for a reticle to be used with a muzzle-loader or shotgun compared to a reticle to be used with a long-range rifle.

Each of the bullet drop compensation sighting areas 54–60 includes a horizontal windage-compensation line that extends from either side of the sighting area. In addition, each of the windage-compensation lines includes one or more rulings 59 that signify adjustment that should be made to the aiming point based upon wind speed. In particular, sighting area 54 includes windage-compensation line 51 having rulings 59, second sighting area 56 has windage-compensation line 53 with rulings 59, third sighting area 58 has windage-compensation line 55 with rulings 59, and fourth sighting area 60 has windage-compensation line 57 having rulings 59. In the embodiment of FIGS. 3 and 4, each of the windage-compensation lines has a ruling 59 at its end and one at its center. The lengths of the windage-compensation lines 51–57 and the positions of the rulings 59 will be described below.

The center horizontal hairline 44 includes enlarged posts 45 on each of its ends. The lower portion 46 of the center vertical hairline 42 similarly includes a post 45. The radially-inner ends 47 of these wide posts 45 are disposed on a circular locus around the central aiming point 52, and are used to compensate for a moving target, as is known in the art. See, for example, U.S. Pat. No. 6,591,537. Thus, the innermost end 47 of the posts 45 are located a predetermined distance from the central aiming point 52.

Figure 5:
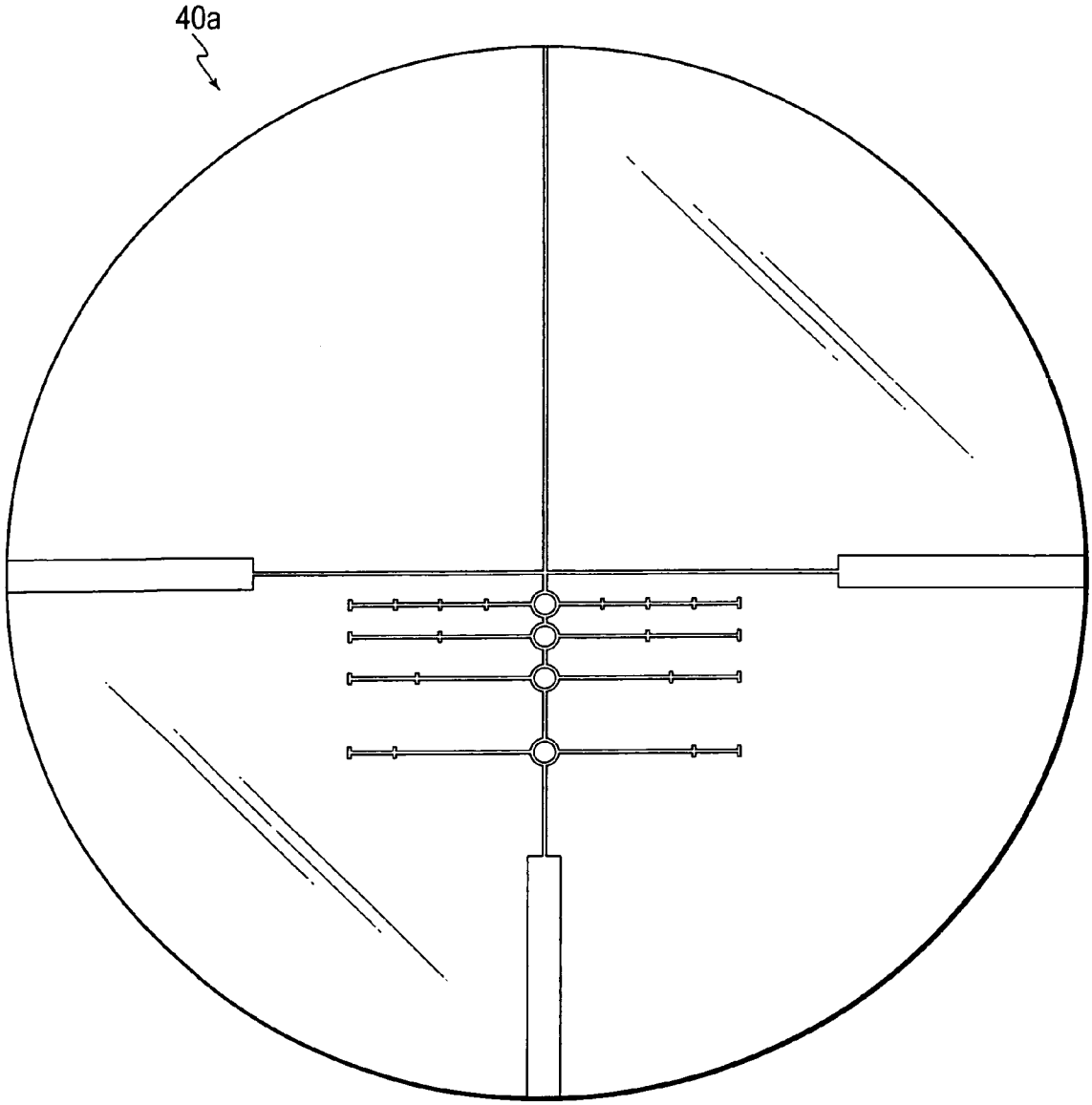
FIG. 5 is a plan view of a gun sight reticle according to a second exemplary embodiment of the invention.
Figure 6:
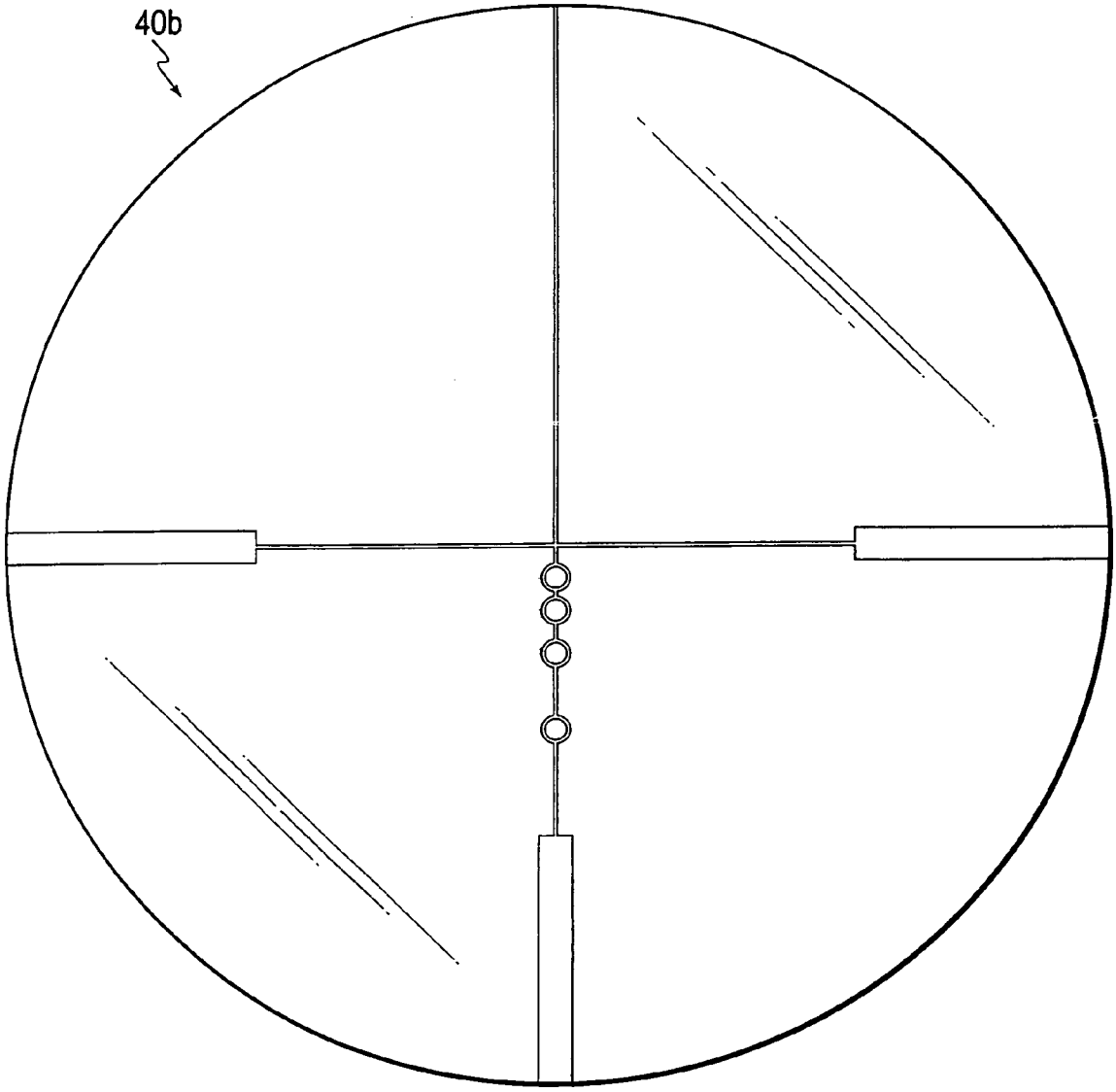
FIG. 6 is a plan view of a gun sight reticle according to a third exemplary embodiment of the invention.

As an alternative to the reticle in FIGS. 3 and 4, the windage-compensation lines for each of the sighting areas can have equal lengths, as shown in modified reticle 40*a* in FIG. 5. These windage-compensation lines may not have rulings at their ends, but preferably have at least one ruling, which would be located at the same location as the central rulings in the embodiment of FIGS. 3–4. If the windage compensation line was sufficiently long, it also could have one or more additional rulings located at distances that are a multiple of the distance that the first ruling is spaced from the center vertical line (see the uppermost windage-compensation line in FIG. 5). As another alternative, the sighting areas can be provided without any windage-compensation lines as shown in the reticle 40*b* in FIG. 6. In addition, the indicia surrounding the sighting areas 54, 56, 58 and 60 does not need to be circular. Other shapes, such as square, diamond, triangle and oval are possible.

The various dimensions and spaced relationships of the indicia on the reticle 40 are expressed as inches of subtention at 100 yards, rather than the actual engraved dimensions on the reticle substrate itself. For example, referring to FIG. 7, each of the posts 45 has a width of dimension a. For a longer-range scope intended for use, for example, with a high-powered rifle, the post 45 would have a dimension a such that when the scope was adjusted to its highest power, the dimension a (the width of the posts 45) would cover one inch of a target located 100 yards from the scope. The dimension a preferably would differ for a reticle that is to be used with a shorter-range gun such as a muzzle-loader or shotgun, because the gun (and thus the scope) would not be used for targeting objects as distant as might be targeted with a high-powered rifle. Thus, for example, the dimension a in a muzzle-loader/shotgun reticle could be two inches at a subtention of 100 yards. That is, the dimension a (the width of the posts 45) would cover two inches of a target located 100 yards from the scope when the scope is adjusted to its highest magnification.

Figure 7:
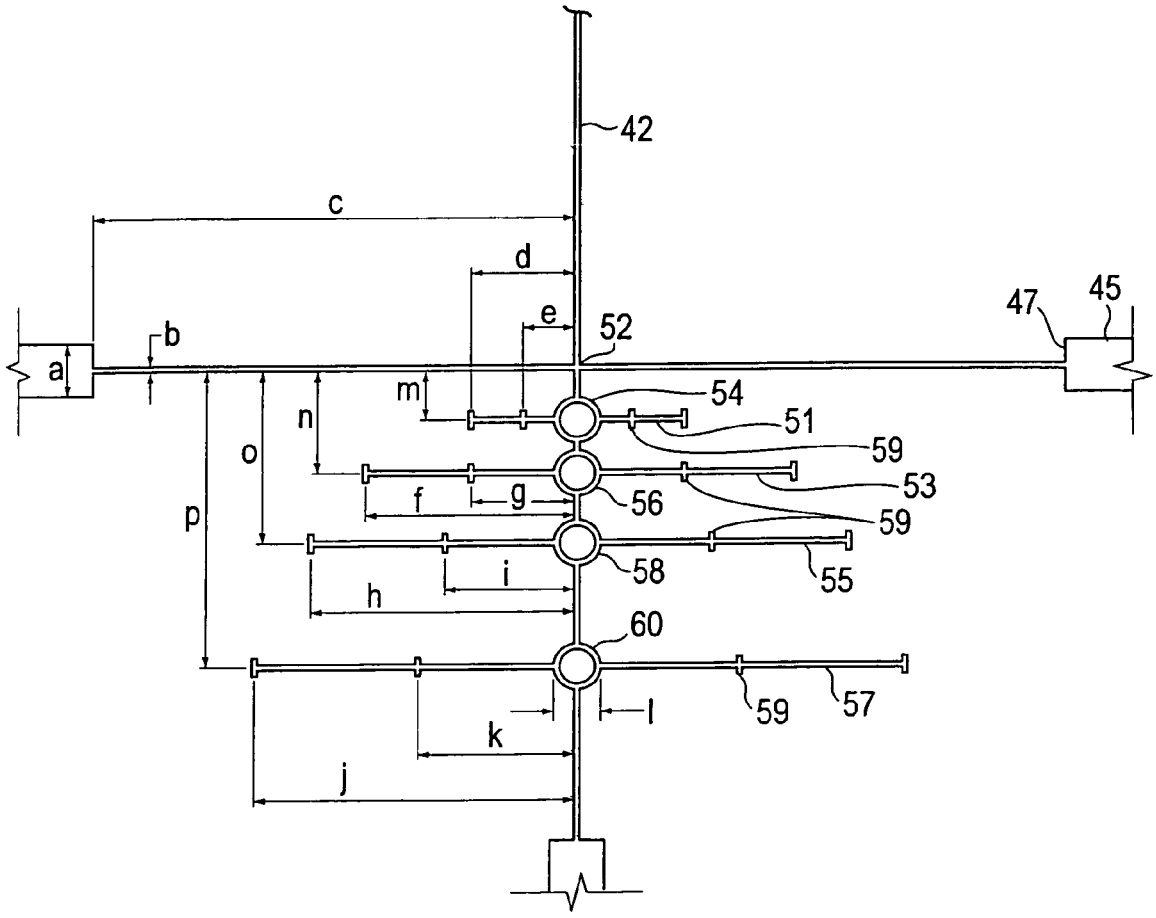
FIG. 7 is a partial plan view of a gun sight reticle according to some embodiments of the invention, and that is used for describing exemplary dimensions of the components of that gun sight reticle.

FIG. 7 illustrates the various dimensions a–p for the components of a reticle having the arrangement of the embodiment shown in FIGS. 3 and 4. Table 1 provides exemplary dimensions for a rifle reticle, whereas Table 2 provides exemplary dimensions for a muzzle-loader or shotgun reticle. The dimensions in Tables 1 and 2 are in inches.

TABLE 1

Dimensions for Rifle Reticle

| Parameter | Description | Dimension |
|---|---|---|
| A | Thickness of post 45 | 1 |
| B | Thickness of lines | 0.3 |
| C | Distance between center vertical hairline 42 and end 47 of posts 45 | Varies by Scope |
| D | Distance between center vertical hairline 42 and end of windage line 51 | 6 |
| E | ½ of d | 3 |
| F | Distance between center vertical hairline 42 and end of windage line 53 | 10 |
| G | ½ of f | 5 |
| H | Distance between center vertical hairline 42 and end of windage line 55 | 13 |
| I | ½ of h | 6.5 |
| J | Distance between center vertical hairline 42 and end of windage line 57 | 16 |
| K | ½ of j | 8 |
| L | Outer diameter of sighting areas 54, 56, 58, 60 | 2 |
| M | Distance between center horizontal hairline 44 and windage line 51 | 2 |
| N | Distance between center horizontal hairline 44 and windage line 53 | 4.5 |
| O | Distance between center horizontal hairline 44 and windage line 55 | 7 |
| P | Distance between center horizontal hairline 44 and windage line 57 | 11 |

TABLE 2

Dimensions for Muzzle-Loader/Shotgun Reticle

| Parameter | Description | Dimension |
|---|---|---|
| a | Thickness of post 45 | 2 |
| b | Thickness of lines | 0.3 |
| c | Distance between center vertical hairline 42 and end 47 of posts 45 | 27 |
| d | Distance between center vertical hairline 42 and end of windage line 51 | 6 |
| e | ½ of d | 3 |
| f | Distance between center vertical hairline 42 and end of windage line 53 | 12 |
| g | ½ of f | 6 |
| h | Distance between center vertical hairline 42 and end of windage line 55 | 15 |
| i | ½ of h | 7.5 |
| j | Distance between center vertical hairline 42 and end of windage line 57 | 18 |
| k | ½ of j | 9 |
| l | Outer diameter of sighting areas 54, 56, 58, 60 | 2.0 |
| m | Distance between center horizontal hairline 44 and windage line 51 | 2 |
| n | Distance between center horizontal hairline 44 and windage line 53 | 4 |
| o | Distance between center horizontal hairline 44 and windage line 55 | 7 |
| p | Distance between center horizontal hairline 44 and windage line 57 | 10 |

With respect to the rifle reticle of Table 1, the central aiming point 52 typically would be zeroed-in at 200 yards, and the bullet drop compensation aiming (sighting) areas would be used for targets located at the following distances: (1) sighting area 54—300 yards; (2) sighting area 56—400 yards; (3) sighting area 58—500 yards; (4) sighting area 60—600 yards. With respect to the muzzle-loader/shotgun reticle of Table 2, the central aiming point 52 typically would be zeroed-in at 100 yards, and the bullet drop compensation aiming (sighting) areas would be used for targets located at the following distances: (1) sighting area 54—150 yards; (2) sighting area 56—200 yards; (3) sighting area 58—225 yards; (4) sighting area 60—250 yards. These values and the dimensions in Tables 1 and 2 are merely examples, the actual values and dimensions will differ depending on the factors mentioned previously (for example, the gun, scope and type of projectile). However, the dimensions provided in Tables 1 and 2 will be suitable for most rifles and muzzle-loaders/shotguns.

While the invention has been described with reference to preferred embodiments thereof, it is to be understood that the invention is not limited to these embodiments or constructions. The invention is intended to cover various modifications and arrangements. While the various elements of the exemplary embodiments are shown in various combinations and configurations, other combinations and configurations, including more, less or only a single element, also are within the spirit and scope of the invention.

What is claimed is:

1. A gun sight reticle comprising:

orthogonally intersecting center horizontal and center vertical straight hairlines;

at least a portion of the vertical hairline located on a first side of the horizontal hairline is discontinuous such that discontinuities are disposed between straight segments of the vertical hairline;

sighting areas disposed in the vertical hairline discontinuities, the sighting areas being circumscribed by indicia that encloses the sighting area;

each sighting area having a dimension of 1.4 inches of subtention at 100 yards;

a distance between centers of two adjacent sighting areas located closest to the center horizontal hairline is smaller than a distance between centers of two adjacent sighting areas located farthest from the center horizontal hairline.

2. The gun sight reticle of claim 1, wherein the sighting areas are circular, and the indicia for each of the circumscribed sighting areas forms a circle.

3. The gun sight reticle of claim 2, wherein at least some of the circumscribed sighting areas include horizontal windage-compensation lines extending from opposite sides of the circumscribed area.

4. The gun sight reticle of claim 3, wherein all of the circumscribed areas include the horizontal windage-compensation lines.

5. The gun sight reticle of claim 4, wherein all of the windage-compensation lines have equal lengths.

6. The gun sight reticle of claim 5, wherein the windage-compensation lines have spaced-apart rulings along their lengths.

7. The gun sight reticle of claim 6, wherein the spacing between adjacent rulings is the same for all of the windage-compensation lines.

8. The gun sight reticle of claim 6, wherein the spacing between two adjacent rulings on the windage-compensation line located closest to the center horizontal hairline is smaller than the spacing between two adjacent rulings on the windage-compensation line located farthest from the center horizontal hairline.

9. The gun sight reticle of claim 4, wherein a length of the windage-compensation lines increases as the windage-compensation are located farther from the center horizontal hairline.

10. The gun sight reticle of claim 9, wherein the windage-compensation lines have spaced-apart rulings along their lengths.

11. The gun sight reticle of claim 10, wherein the spacing between adjacent rulings is the same for all of the windage-compensation lines.

12. The gun sight reticle of claim 10, wherein the spacing between two adjacent rulings on the windage-compensation line located closest to the center horizontal hairline is smaller than the spacing between two adjacent rulings on the windage-compensation line located farthest from the center horizontal hairline.

13. The gun sight reticle of claim 1, wherein at least some of the circumscribed sighting areas include horizontal windage-compensation lines extending from opposite sides of the circumscribed area.

14. The gun sight reticle of claim 13, wherein all of the circumscribed areas include the horizontal windage-compensation lines.

15. The gun sight reticle of claim 14, wherein all of the windage-compensation lines have equal lengths.

16. The gun sight reticle of claim 15, wherein the windage-compensation lines have spaced-apart rulings along their lengths.

17. The gun sight reticle of claim 16, wherein the spacing between adjacent rulings is the same for all of the windage-compensation lines.

18. The gun sight reticle of claim 16, wherein the spacing between two adjacent rulings on the windage-compensation line located closest to the center horizontal hairline is smaller than the spacing between two adjacent rulings on the windage-compensation line located farthest from the center horizontal hairline.

19. The gun sight reticle of claim 14, wherein a length of the windage-compensation lines increases as the windage-compensation are located farther from the center horizontal hairline.

20. The gun sight reticle of claim 19, wherein the windage-compensation lines have spaced-apart rulings along their lengths.

21. The gun sight reticle of claim 20, wherein the spacing between adjacent rulings is the same for all of the windage-compensation lines.

22. The gun sight reticle of claim 20, wherein the spacing between two adjacent rulings on the windage-compensation line located closest to the center horizontal hairline is smaller than the spacing between two adjacent rulings on the windage-compensation line located farthest from the center horizontal hairline.

23. A telescopic gun sight comprising:

a housing;

an objective lens disposed near a first end of the housing;

an ocular lens disposed near a second end of the housing; and the gun sight reticle of claim 1 located within the housing between the objective lens and the ocular lens.

24. A gun sight reticle comprising:

orthogonally intersecting center horizontal and center vertical straight hairlines;

at least a portion of the vertical hairline located on a first side of the horizontal hairline is discontinuous such that discontinuities are disposed between straight segments of the vertical hairline;

sighting areas disposed in the vertical hairline discontinuities, the sighting areas being circumscribed by indicia in the shape of a circle that encloses the sighting area;

each sighting area having an inner diameter of 1.4 inches of subtention at 100 yards and an outer diameter of 2 inches of subtention at 100 yards;

a distance between centers of two adjacent sighting areas located closest to the center horizontal hairline is smaller than a distance between centers of two adjacent sighting areas located farthest from the center horizontal hairline;

each of the sighting areas does not contain any hairline or other indicia.

25. The gun sight reticle of claim 24, wherein each of the circumscribed sighting areas includes horizontal windage-compensation lines extending from opposite sides of the circumscribed area.

26. The gun sight reticle of claim 25, wherein the windage-compensation lines have spaced-apart rulings along their lengths.

27. The gun sight reticle of claim 26, wherein the spacing between two adjacent rulings on the windage-compensation line located closest to the center horizontal hairline is smaller than the spacing between two adjacent rulings on the windage-compensation line located farthest from the center horizontal hairline.

28. The gun sight reticle of claim 25, wherein a length of the windage-compensation lines increases as the windage-compensation are located farther from the center horizontal hairline.

29. A telescopic gun sight comprising:

a housing;

an objective lens disposed near a first end of the housing;

an ocular lens disposed near a second end of the housing; and the gun sight reticle of claim 24 located within the housing between the objective lens and the ocular lens.

* * * * *